US011415920B2

(12) United States Patent
Iwadate

(10) Patent No.: US 11,415,920 B2
(45) Date of Patent: Aug. 16, 2022

(54) IMAGE FORMING APPARATUS

(71) Applicant: CANON KABUSHIKI KAISHA, Tokyo (JP)

(72) Inventor: Shinnosuke Iwadate, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/473,133

(22) Filed: Sep. 13, 2021

(65) Prior Publication Data

US 2022/0082974 A1 Mar. 17, 2022

(30) Foreign Application Priority Data

Sep. 17, 2020 (JP) ..... JP2020-156551

(51) Int. Cl.
*G03G 15/00* (2006.01)

(52) U.S. Cl.
CPC ..... *G03G 15/5062* (2013.01); *G03G 15/502* (2013.01); *G03G 2215/00067* (2013.01)

(58) Field of Classification Search
CPC ..... G03G 15/5062; G03G 15/502; G03G 2215/00067
See application file for complete search history.

(56) References Cited

U.S. PATENT DOCUMENTS 7,243,045 B2 * 7/2007 Uwatoko ..... G03G 15/55 399/9
8,433,209 B2 4/2013 Ito
2011/0135321 A1 6/2011 Ito
2018/0130192 A1 * 5/2018 Yago ..... G01N 21/89

FOREIGN PATENT DOCUMENTS

JP 2011123106 A 6/2011

* cited by examiner

*Primary Examiner* — Susan S Lee
(74) *Attorney, Agent, or Firm* — Canon U.S.A., Inc. IP Division

(57) ABSTRACT

An image forming apparatus includes an image forming unit for forming an image on a sheet, a reading unit for reading the image on the sheet and an inspection unit for inspecting whether an image formation failure has occurred by comparing the image read by the reading unit with a reference image registered in advance. The image forming apparatus executes the inspection with the inspection unit in a first inspection mode or a second inspection mode. The first inspection mode is a mode in which the inspection unit executes the inspection on all sheets on which the image is formed by the image forming unit. The second inspection mode is a mode in which the inspection unit executes the inspection on some of the sheets on which the image is formed by the image forming unit, and the inspection unit does not execute the inspection on the other sheets.

9 Claims, 9 Drawing Sheets t = 0
ELAPSED TIME t
IMAGE FORMATION
INSPECTION
i1
i2
i3
i4
i5
i6
i7
i8
i9
i10
i11
i12
k5
k6
k7
k8
t1
t2
t3
t4

IMAGE FORMATION (ALL SHEETS INSPECTION)
INSPECTION (ALL SHEETS INSPECTION)
m1
m2
m3
m4
m5
m6
m7
m8
m9
m10
m11
m12
n1
n2
n3
n4
n5
n6
n7
n8
n9
n10
n11
n12
t3

IMAGE FORMING APPARATUS

BACKGROUND

Field of the Disclosure

The present disclosure relates to an image forming apparatus that forms an image on a sheet.

Description of the Related Art

An image forming apparatus including an inspection function for executing an inspection on a sheet on which an image is formed has been known. An image forming apparatus discussed in Japanese Patent Application Laid-Open No. 2011-123106 includes a line sensor that reads an image on a printed material discharged from a printer unit. The image read by the line sensor is compared with a reference image registered in advance as a reference, to thereby inspect whether a print failure has occurred.

In the image forming apparatus discussed in Japanese Patent Application Laid-Open No. 2011-123106, the processing of comparing the read image with the reference image is executed on all sheets printed by the printer unit. However, if the inspection processing is executed on all sheets, the throughput of the image forming apparatus can be reduced.

SUMMARY

The present disclosure is directed to providing an image forming apparatus that performs inspection processing on a printed sheet in an appropriate mode.

According to embodiments of the present disclosure, an image forming apparatus includes an image forming unit configured to form an image on a sheet, a reading unit configured to read the image on the sheet, the image being formed by the image forming unit, and an inspection unit configured to inspect whether an image formation failure has occurred by comparing the image read by the reading unit with a reference image registered in advance. The image forming apparatus executes the inspection with the inspection unit in a first inspection mode or a second inspection mode. The first inspection mode is a mode in which the inspection unit executes the inspection on all sheets on which the image is formed by the image forming unit. The second inspection mode is a mode in which the inspection unit executes the inspection on some of the sheets on which the image is formed by the image forming unit, and the inspection unit does not execute the inspection on the other sheets.

Further features of the present disclosure will become apparent from the following description of exemplary embodiments with reference to the attached drawings.

DESCRIPTION OF THE EMBODIMENTS

<Schematic Configuration of Image Forming Apparatus>

Figure 1:
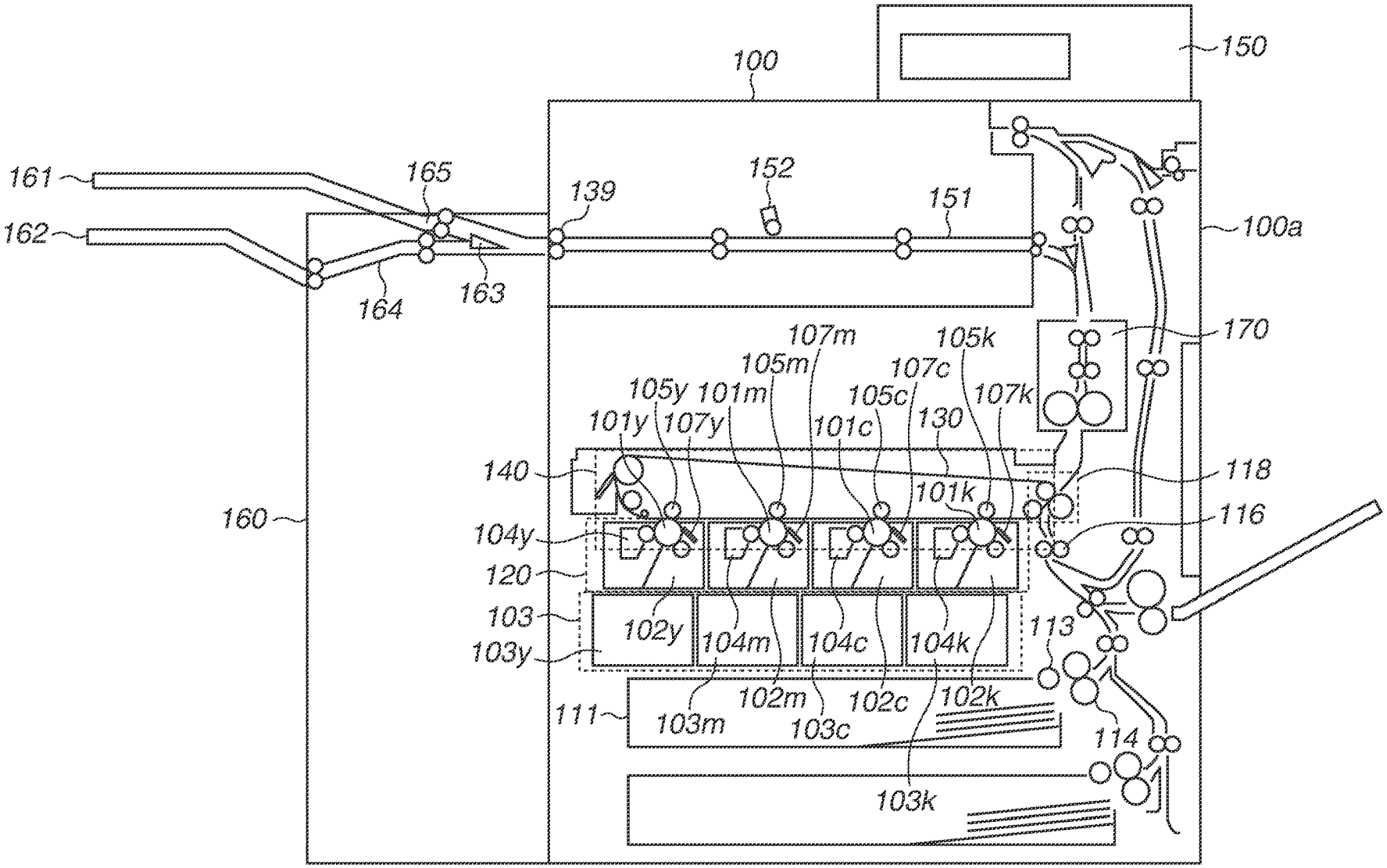
FIG. 1 illustrates a configuration example of an image forming apparatus.

FIG. 1 is a configuration diagram illustrating a configuration example of an image forming apparatus according to an exemplary embodiment of the present disclosure. An image forming apparatus 100 includes a printer unit 100*a* and a user interface (UI) 150. The printer unit 100*a* is an example of an image forming unit that forms an image on a sheet. The UI 150 is an example of an operation unit that is operated by a user to set an inspection mode to be described below. The printer unit 100*a* includes an image forming unit 120, a laser scanner unit 103, an intermediate transfer unit 140, a secondary transfer unit 118, a fixing unit 170, and various rollers for conveying a sheet on which an image is formed.

The image forming unit 120 includes photosensitive drums 101*y*, 101*m*, 101*c*, and 101*k* each serving as an image carrying member, and charging rollers 102*y*, 102*m*, 102*c*, and 102*k*. The image forming unit 120 also includes developing units 104*y*, 104*m*, 104*c*, and 104*k*, and drum cleaners 107*y*, 107*m*, 107*c*, and 107*k*. The suffixes "y", "m", "c", and "k" of the respective reference symbols represent parts corresponding to the colors of yellow, magenta, cyan, and black, respectively. For example, the image forming units 120 (*y, m, c, k*) indicate the yellow image forming unit 120*y*, the magenta image forming unit 120*m*, the cyan image forming unit 120*c*, and the black image forming unit 120*k*. In the following description, unless each part is required to be particularly distinguished from other parts, the image forming units 120 (*y, m, c, k*) may be referred to simply as the image forming unit 120. The same applies to the other components such as the photosensitive drums 101 (*y, m, c, k*).

The charging rollers 102 (*y, m, c, k*) charge the surfaces of the photosensitive drums 101 (*y, m, c, k*), respectively. The developing units 104 (*y, m, c, k*) develop electrostatic latent images by causing toner to adhere to the photosensitive drums 101 (*y, m, c, k*), respectively. A yellow toner image is formed and carried on the photosensitive drum 101*y*. A magenta toner image is formed and carried on the photosensitive drum 101*m*. A cyan toner image is formed and carried on the photosensitive drum 101*c*. A black toner image is formed and carried on the photosensitive drum 101*k*. The drum cleaner 107 removes toner remaining on the corresponding photosensitive drum 101 after the toner is transferred onto an intermediate transfer belt 130.

The laser scanner units 103 (*y, m, c, k*) emit light corresponding to a video signal obtained by converting an image signal generated by a scanner portion into a digital signal. The laser scanner units 103 (*y, m, c, k*) include the laser scanner 103*y*, the laser scanner 103*m*, the laser scanner 103*c*, and the laser scanner 103*k*. The laser scanners 103*y* to 103*k* apply laser light corresponding to video signals of yellow, magenta, cyan, and black to the respective photosensitive drums 101*y* to 101*k*.

The intermediate transfer unit 140 includes the intermediate transfer belt 130 as a belt member, and primary transfer rollers 105 (*y, m, c, k*). Each of the primary transfer rollers 105 (*y, m, c, k*) is provided to sandwich the intermediate transfer belt 130 between the primary transfer roller 105 (*y, m, c, k*) and the corresponding photosensitive drum 101 (y, m, c, k). The primary transfer rollers 105 (*y, m, c, k*) transfer the toner images of the respective colors formed on the photosensitive drums 101 (*y, m, c, k*), respectively, onto the intermediate transfer belt 130. The toner images of the respective colors are transferred onto the intermediate transfer belt 130 such that the toner images of the respective colors are superimposed on each other, to thereby form a full-color toner image.

The secondary transfer unit 118 transfers the toner images, which have been transferred onto the intermediate transfer belt 130, onto a sheet. The sheet is conveyed to the secondary transfer roller 118 from a sheet feeding cassette 111 by a sheet feeding pickup roller 113, sheet feeding rollers 114, and registration rollers 116.

The fixing unit 170 heats and pressurizes the sheet onto which the toner images have been transferred by the secondary transfer roller 118, to thereby fix the toner images onto the sheet. This brings the image formation on the sheet to an end. The sheet on which the image has been formed passes through a line sensor 152, which is located at a downstream side of the fixing unit 170 and provided on a conveyance path 151, and is discharged to a finisher 160 through discharge rollers 139.

The finisher 160 includes a flapper 163, an escape conveyance path 165 for conveying the sheet to an escape tray 161, and a discharge conveyance path 164 for conveying the sheet to a discharge tray 162.

The UI 150 includes a touch panel that is operated by the user.

While the present exemplary embodiment illustrates the electrophotographic image forming apparatus 100 as an example of the image forming apparatus according to the present exemplary embodiment, the present disclosure is not limited to this example. For example, an inkjet image forming apparatus may also be used.

[Schematic Configuration of Image Forming Apparatus]

Figure 2:
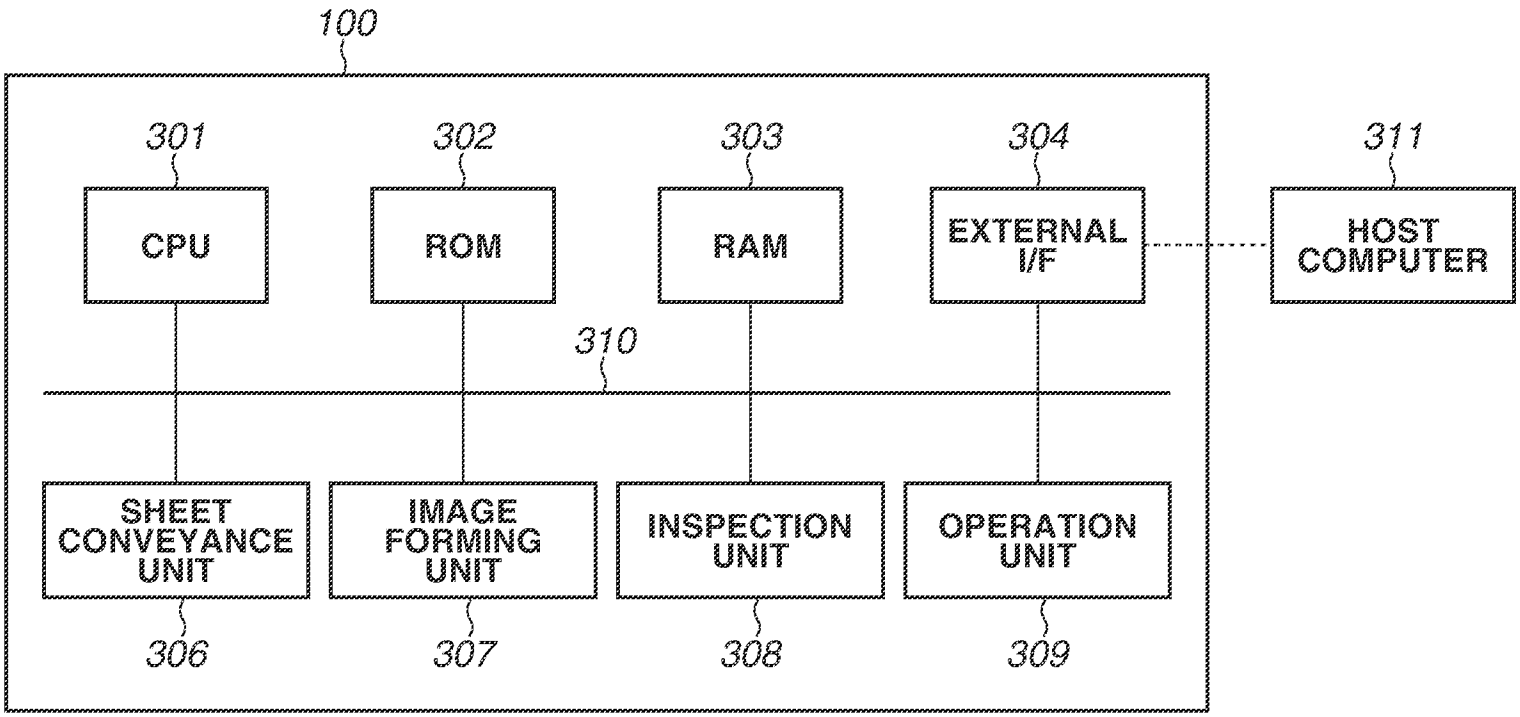
FIG. 2 is a control block diagram of the image forming apparatus.

FIG. 2 is a control block diagram of the image forming apparatus 100. A central processing unit (CPU) 301 executes programs stored in a read-only memory (ROM) 302, to thereby control the image forming apparatus 100. A random access memory (RAM) 303 stores control variables and image data that are used for the CPU 301 to execute control processing. An external interface (I/F) 304 is a communication interface for connecting the image forming apparatus 100 and an external host computer 311 to each other. Upon receiving image data and an image formation start signal from the host computer 311, the image forming apparatus 100 starts an image forming operation. A sheet conveyance unit 306 is an example of a conveyance unit for conveying a sheet, and the sheet conveyance unit 306 includes a plurality of motors and rollers. An image forming unit 307 includes the image forming unit 120, the laser scanner unit 103, the intermediate transfer unit 140, the secondary transfer unit 118, and the fixing unit 170. The image forming unit 307 forms an image on a sheet based on digital image data stored in the RAM 303. An inspection unit 308 includes the line sensor 152 as an example of a reading unit. The inspection unit 308 reads an image formed on a sheet, converts the image into digital image data, and stores the digital image data in the RAM 303. An operation unit 309 is a user interface, which is an example of a setting unit used for the user to operate the image forming apparatus 100, and the operation unit 309 corresponds to the UI 150 illustrated in FIG. 1. The above-described components 301 to 309 are connected to each other via a data bus 310.

[Basic Image Forming Operation of Image Forming Apparatus]

An image forming operation of the image forming apparatus 100 will now be described with reference to FIGS. 1 and 2. When a print operation start instruction is input, the CPU 301 controls the image forming unit 120 through the image forming unit 307 to prepare for starting the image forming operation. After the preparation for the image forming units 120 (*y, m, c, k*) is completed, the CPU 301 controls each of the image forming units 120 (*y, m, c, k*) through the image forming unit 307. Thus, the CPU 301 starts the image forming operation based on the image data stored in the RAM 303. In the image forming units 120 (*y, m, c, k*), the surface of the photosensitive drum 101 is charged and then latent images are formed on the surface of the photosensitive drum 101 by the laser light applied from the laser scanner unit 103.

The formed latent images are developed on the surface of the photosensitive drum 101 with toner contained in the developing unit 104. Thereafter, at each of the black-and-white primary transfer roller 105*k* and the color primary transfer rollers 105 (*y, m, c*), a primary transfer voltage is applied to the toner images developed on the surface of the photosensitive drum 101, and the toner images are transferred onto the intermediate transfer belt 130. The toner images transferred onto the intermediate transfer belt 130 are delivered to the secondary transfer unit 118 by the rotation of the intermediate transfer belt 130.

The CPU 301 drives a conveyance motor (not illustrated) of the sheet conveyance unit 306 to be ready in time for the toner images to reach the secondary transfer unit 118. The conveyance motor is a drive source for each of the sheet feeding pickup roller 113, the sheet feeding rollers 114, the registration rollers 116, and the discharge rollers 139. In response to the driving of the conveyance motor, the sheet feeding pickup roller 113 is rotationally driven and sheets are fed one by one from the sheet feeding cassette 111. A secondary transfer voltage is applied to the sheet and toner images that have reached the secondary transfer unit 118, thereby transferring the toner images onto the sheet.

The sheet onto which the toner images are transferred is conveyed to the fixing unit 170. In the fixing unit 170, the toner images formed on the sheet are heated and fixed onto the sheet. After that, the CPU 301 causes the line sensor 152 to read the images on the sheet conveyed through conveyance rollers controlled by the sheet conveyance unit 306, and executes inspection processing to be described below, and then discharges the sheet to the finisher 160.

The line sensor 152 is provided on the conveyance path 151, and reads images on a sheet when the sheet passes through the conveyance path 151. The line sensor 152 acquires image data on the sheet, which is being conveyed, with a preliminarily set resolution (300 dpi in the present exemplary embodiment) in units of line width. The CPU 301 sends a resolution setting instruction to the line sensor 152 in advance, acquires all data obtained during a period from when the sheet reaches the line sensor 152 to when the sheet has passed through the line sensor 152, and stores the data in the RAM 303, thereby acquiring image data on the entire area of the sheet. The sheet discharged to the finisher 160 is further discharged to different discharge destinations according to the result of the inspection processing. The path for the sheet that is determined to be a product by the inspection processing is changed to the discharge conveyance path 164 by the flapper 163. The path for the sheet that is not determined to be a product by the inspection processing is changed to the escape conveyance path 165 by the flapper 163, and the sheet is discharged onto the escape tray 161. Then, information indicating that a print failure has occurred is displayed on the UI 150 and the print operation is suspended. The basic image forming operation described above is merely an example and the present disclosure is not limited to the above-described configuration.

[Inspection Processing]

Figure 3:
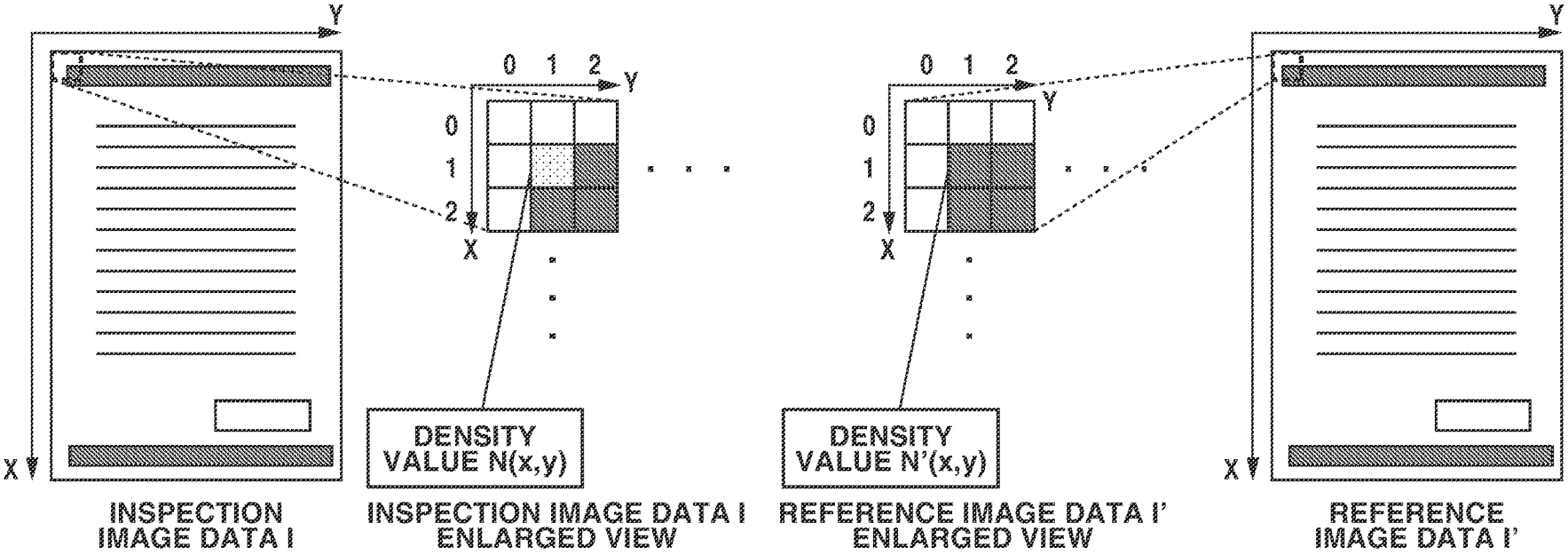
FIG. 3 is an explanatory diagram illustrating inspection processing.

A method for inspection processing in the inspection unit 308 will be described with reference to FIG. 3. FIG. 3 illustrates images to be compared by the inspection unit 308. Inspection image data I is image data on the entire area of the sheet read by the CPU 301 with a resolution set in the line sensor 152. An enlarged view of the inspection image data I illustrated in FIG. 3 is an enlarged view of a part of the inspection image data I that is displayed in a matrix of areas each corresponding to one pixel. A density value N(x, y) indicates a density value for, for example, an area corresponding to one pixel unit in the inspection image data I. Assuming that the density value at the coordinates of x=1 and y=1 illustrated in the enlarged view of the inspection image data I is 127, the density value N(1, 1)=127 holds.

Reference image data I', which is an example of a reference image, is obtained by converting digital image data input through the external I/F 304 with the same resolution as the resolution set in the line sensor 152 by the CPU 301. An enlarged view of the reference image data I' illustrated in FIG. 3 is an enlarged view of a part of the reference image data I' that is displayed in a matrix of areas each corresponding to one pixel unit. A density value N'(x, y) indicates a density value for an area corresponding to one pixel unit in the reference image data I'. For example, assuming that the density value at the coordinates of x=1 and y=1 illustrated in the enlarged view of the reference image data I' is 255, the density value N'(1, 1)=255 holds.

In the present exemplary embodiment, image data obtained by reading the image with the line sensor 152 is used as the reference image data I' corresponding to the reference image. Instead of the image data read by the line sensor 152, image data registered in advance from the host computer 311 may be used.

Density comparison processing is performed by calculating a density comparison value D(x, y) at specific pixel coordinates (x, y). D(x, y) is calculated by the following expression.

$$D(x,y)=N(x,y)-N'(x,y)$$

A pixel determination result Z(x, y) at the pixel coordinates (x, y) is then calculated using the calculated density comparison value D(x, y). In this case, Z(x, y) indicates the value of the pixel determination result at the pixel coordinates (x, y) and can take either a value of "0" or "1". The absolute value of the density comparison value D(x, y) is compared with a preliminarily set allowable density difference. If |density comparison value D(x, y)|≤(allowable density difference) is satisfied, Z(x, y)=1 (pixel determination OK) holds. If |density comparison value D(x, y)|> (allowable density difference) is satisfied, Z(x, y)=0 (pixel determination NG) holds. In the present exemplary embodiment, assuming that the allowable density difference is set to 40, the density data value at the coordinates (x, y) in the inspection image data I is 255, and the density data value at the coordinates (x, y) in the reference image data I' is 127, |density comparison value D(x, y)|=|127−255|=128>40 holds. Accordingly, the pixel determination result Z(x, y) at the coordinates (x, y) is 0.

After the number of NG pixels with respect to the number of pixels corresponding to the entire area of the sheet is calculated, an NG pixel number D-ALL is obtained by the following expression.

$$D\text{-ALL}=(x_\max\times y_\max)-\Sigma_{n=0}^{x_max}\Sigma_{m=0}^{y_max}Z(n,m) \quad (1)$$

In Expression (1), x_max represents a maximum value of the coordinate x in the inspection image data I, and y_max represents a maximum value of the coordinate y in the inspection image data I. For example, in the case of executing inspection processing on image data printed on an A4-size sheet (297 mm×210 mm) with a resolution of 300 dots/inch, the number of pixels on the A4-size sheet is about 8,700,000 pixels (3,508×2,480). X_max is 3,508 and y_max is 2,480, accordingly. The calculated NG pixel number D-ALL is compared with a predetermined inspection NG determination threshold, thereby making a final inspection determination on the inspection image data I. For example, when the inspection NG threshold is set to 100,000 pixels and is compared with image data on an A4-size sheet, 3,508×2,480−100,000=8,599,840 holds. Accordingly, the image is determined to be OK if the total of the pixel determination result Z is greater than or equal to 7,699,840, and the image is determined to be NG if the total is less than 7,699,840.

[Inspection Mode Setting by Operation Unit]

Figure 4A:
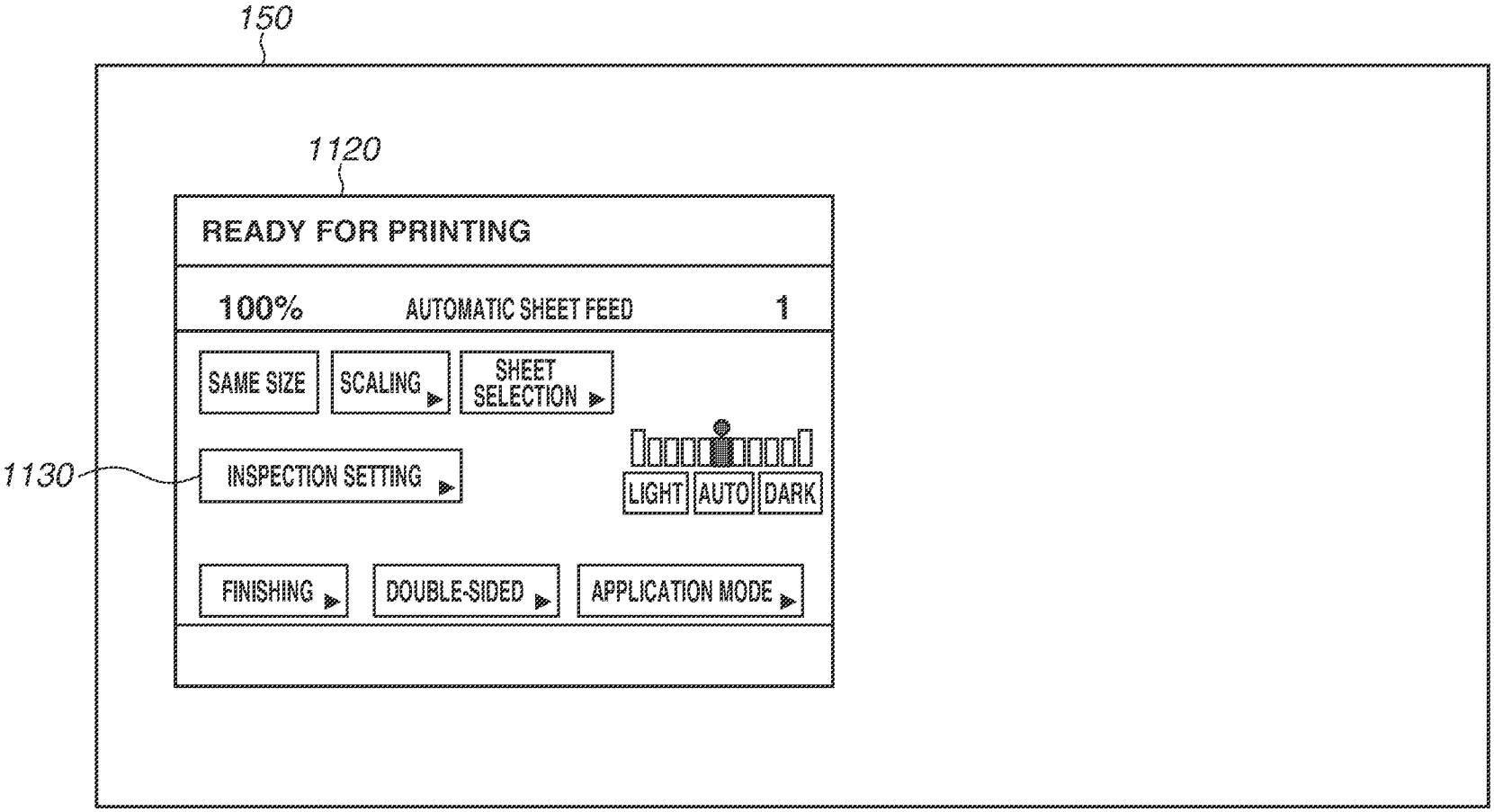
FIG. 4A is a schematic diagram illustrating an operation unit.
Figure 4B:
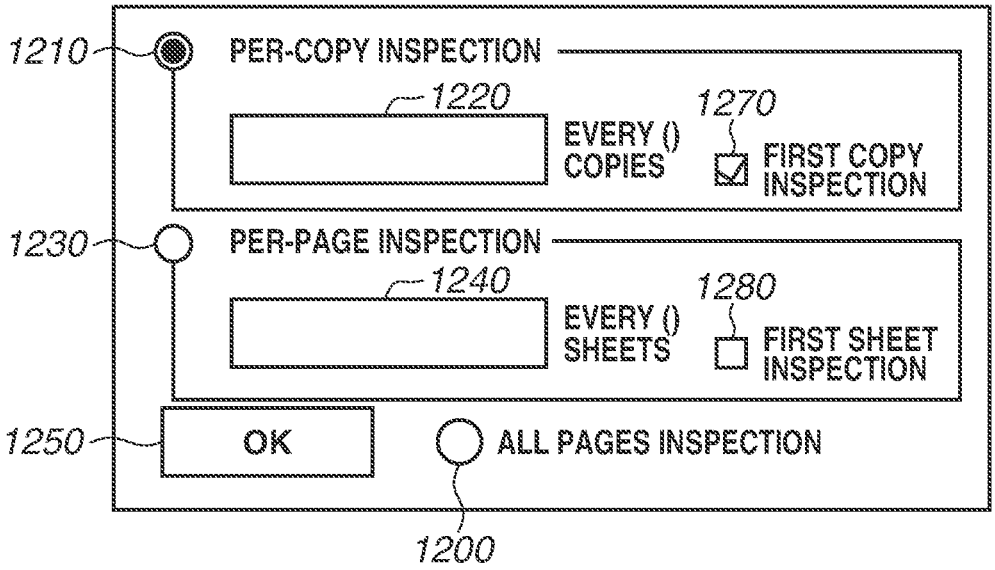
FIG. 4B illustrates an example of a screen for setting an inspection mode.

FIG. 4A is a front view of the UI 150. In the UI 150, a display unit 1120 provided with a touch panel formed at an upper portion thereof is disposed, and software keys can be created on the screen. An "inspection setting" software key 1130 is displayed on the display unit 1120. When the software key 1130 is pressed, a pop-up screen illustrated in FIG. 4B is displayed on the display unit 1120. On this pop-up screen, the inspection mode for the image forming apparatus 100 can be set.

FIG. 4B illustrates the pop-up screen for setting the inspection mode. When an OK button 1250 is pressed, any one of an all pages inspection mode radio button 1200, a per-copy inspection mode radio button 1210, and a per-page inspection radio button 1230 can be selected. When the OK button 1250 is pressed and the all pages inspection mode radio button 1200 is selected, an all sheets inspection mode, which is an example of a first inspection mode, is set. When the per-page inspection radio button 1230 is selected, a per-page inspection mode, which is an example of a second inspection mode, is set. When the per-copy inspection mode radio button 1210 is selected, a per-copy inspection mode, which is another example of the second inspection mode, is set. According to the inspection mode, the number of copies input in a per-copy inspection interval textbox 1220, or the number of pages (number of sheets) input in a per-page inspection interval textbox 1240 is stored in the RAM 303 as an inspection interval. The all sheets inspection mode is an example of a mode in which an image defect inspection is executed on all sheets received from the image forming unit 120. The per-copy inspection mode and the per-page inspection mode are examples of a mode in which an image defect inspection is executed on some of the sheets received from the image forming unit 120.

A check result of a first copy inspection checkbox 1270, or a check result of a first sheet inspection checkbox 1280 is stored as a first copy/first sheet check setting in the RAM 303.

Figure 4C:
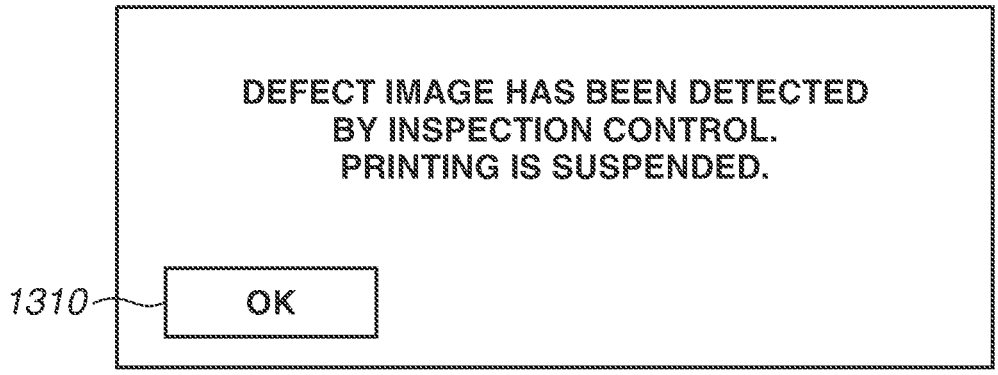
FIG. 4C illustrates an example of a screen for displaying inspection NG.

FIG. 4C illustrates a pop-up screen to be displayed on the display unit 1120 when the inspection unit 308 determines that the inspection result is NG. When a defect display screen OK button 1310 is pressed, the pop-up screen closes.

The image forming apparatus 100 according to the present exemplary embodiment has a configuration in which the CPU 301 stores "1" as the inspection interval in the RAM 303 when the image forming apparatus 100 is powered on, and the inspection processing is set for each page or all sheets. Thus, the image forming apparatus 100 has a configuration in which any one of a plurality of inspection modes, including the all sheets inspection mode, the per-copy inspection mode, and the per-page inspection mode, can be set using the UI 150 serving as the operation unit. In the present exemplary embodiment, any one of the inspection modes is set using the UI 150, but the inspection mode setting may alternatively be input through the external I/F 304.

The present exemplary embodiment is described assuming that any one of the all sheets inspection mode, the per-copy inspection mode, and the per-page inspection mode is set. However, for example, both a copy interval and a page interval may be set.

Figure 5A:
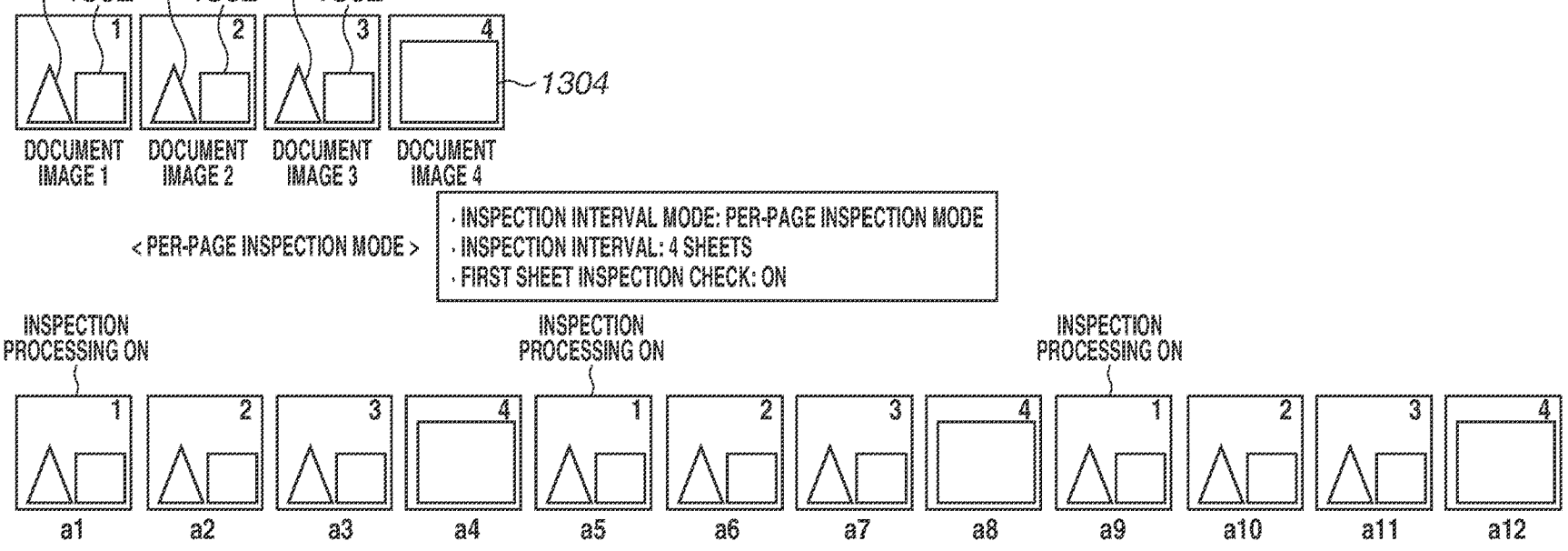
FIGS. 5A and 5B are explanatory diagrams each illustrating an inspection interval.
Figure 5B:
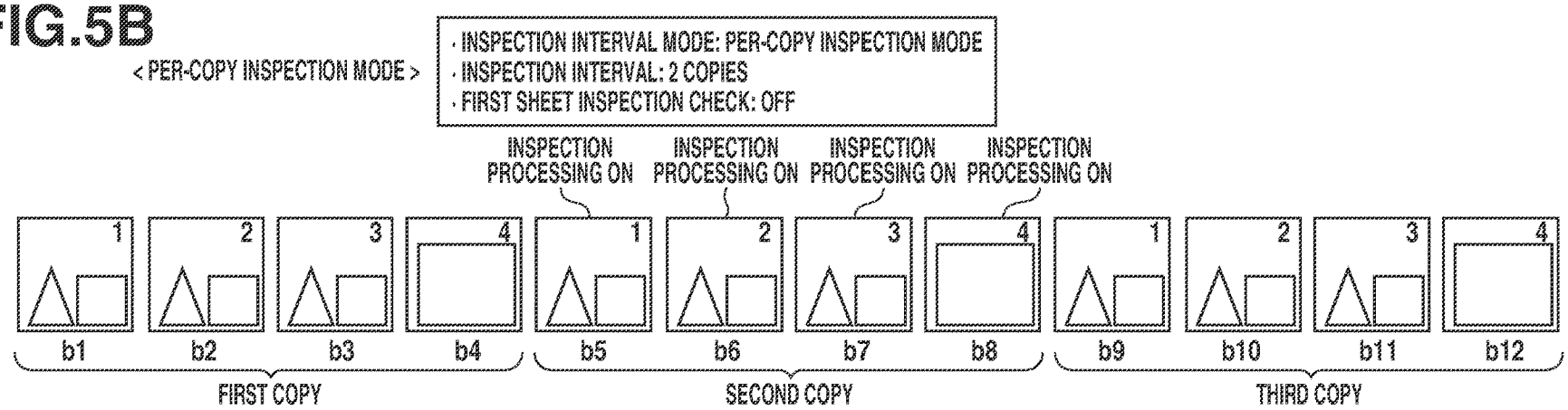

FIGS. 5A and 5B are schematic diagrams each illustrating an inspection interval for a printed material based on the inspection mode setting described above with reference to FIGS. 4A to 4C. A method for setting inspection processing ON/OFF on each sheet according to the inspection mode setting when three copies of document images 1 to 4 are printed as document images will be described below. As described in detail below, print images set to inspection processing ON are read by the line sensor 152, and the inspection processing described above with reference to FIG. 3 is executed. Images 1301 and 1302 in each of the document images 1 to 3 are black-and-white images formed only by the developing unit 104*k* illustrated in FIG. 1, and an image 1304 in the document image 4 is a color image formed only by the developing unit 104*c*.

FIG. 5A is a schematic diagram illustrating an inspection interval in the per-page inspection mode. Printed materials a1 to a12 are printed in order from a1 to a12. This example illustrates sheets to be inspected (sheets set to inspection processing ON) when the per-page inspection mode, inspection interval="four sheets", and first sheet inspection checkbox="ON" are set.

Since the first sheet inspection check is "ON", it is determined that the inspection processing is executed (inspection processing ON) on the printed material a1, which is a first sheet in a job. Thereafter, it is determined that inspection processing ON is set at each page inspection interval. Since four sheets are set as the inspection interval in the example illustrated in FIG. 5A, it is determined that inspection processing ON is set to the printed material a5, which is located at the inspection interval of four sheets from the printed material a1, and to the printed material a9, which is located at the inspection interval of four sheets from the printed material a5.

FIG. 5B is an explanatory diagram illustrating an inspection interval in the per-copy inspection mode. Printed materials b1 to b12 are printed in order from b1 to b12. In this example, inspection interval="2 copies" and first copy inspection checkbox="OFF" are set.

Since the first copy inspection check is OFF, it is determined that inspection processing OFF is set to the printed materials b1 to b4 of the first print copy. Thereafter, it is determined that inspection processing ON is set at each copy inspection interval. Since the inspection interval is two copies, it is determined that inspection processing ON is set to the printed materials b5 to b8 of the second copy. FIGS. 5A and 5B illustrate an example where three copies are printed. However, if four copies are printed, it is determined that inspection processing ON is also set to the fourth copy according to the inspection interval.

Use examples of the per-page inspection mode and the per-copy inspection mode will now be described. According to the per-page inspection mode, a defect that occurs due to a factor other than image formation factors can be effectively detected. For example, if the surface of the registration rollers 116 illustrated in FIG. 1 is contaminated with grease or the like during a print job, the grease or the like may adhere to the subsequent printed materials and the print surface may be contaminated. In addition, a holding force in a front-rear direction of the registration rollers 116 varies, which may cause the sheet to be skewed. If the image forming unit 307 executes image formation processing in this state, images may be obliquely formed on the sheets subsequently fed. In the case of detecting a defect that occurs in the subsequent printed materials during the print job, the inspection processing is executed at a predetermined image interval. If such a defect is detected, it is assumed that the printed materials for which inspection processing OK has previously been determined are also discarded. In the per-page inspection mode described above with reference to FIG. 5A, it is possible to prevent a defect image from being continuously printed at a set page interval. In the per-copy inspection mode described above with reference to FIG. 5B, the inspection processing is executed on every other sheet in the printed materials b5 to b8, and the inspection processing is not executed on the printed materials b9 to b12. Thus, the inspection interval is varied depending on the number of pages in one copy. In a case where a large number of pages are included in one copy, if such a defect is detected, it is assumed that there is a need to discard a larger number of printed materials than expected, or there is a need to execute inspection processing on all pages in the copy to be inspected, which may lead to a further decrease in throughput than expected.

In contrast, in the per-copy inspection mode, a defect image that occurs in the case of printing a plurality of copies of a plurality of document images as described above with reference to FIG. 5B can be effectively detected. As described above with reference to FIG. 5A, the images 1301 and 1302 formed on the document images 1 to 3 illustrated in FIG. 5A are formed only by the developing unit 104*k*, and the document image 1304 is formed only by the developing unit 104*c*. In this case, for example, if a defect occurs in the developing unit 104*c* illustrated in FIG. 1 during the print operation, the defect may occur only in the image formed by the developing unit 104*c*. As described above, the defect image occurs only in the printed materials a4, a8, and a12, or the printed materials b4, b8, and b12, which are printed materials of the document image 4 formed by the developing unit 104*c*. In the inspection mode setting illustrated in FIG. 5A, inspection processing ON is not set to the printed materials a4, a8, and a12, which makes it difficult to detect the defect image. In contrast, in the per-copy inspection mode described above with reference to FIG. 5B, the printed materials of all document images are inspected without fail at a set copy interval and the defect image can be detected in the inspection processing on the printed material b8. It is thereby possible to prevent the defect image from being continuously printed. Consequently, it is possible to prevent the omission of defect image inspection.

Use examples of the result of the first copy inspection checkbox and the result of the first sheet inspection checkbox described above with reference to FIGS. 5A and 5B will be now described. Heretofore, an operation in which test printing of a first copy or a first sheet is executed before printing a plurality of copies of a document image, and if there is no problem with the test print checked by the user, printing of the plurality of copies is executed has been carried out in general. In this case, since the user checks the test print, it is less likely that a defect image may be detected in the inspection processing on the first sheet or the first copy, and thus it can be determined that the first copy inspection checkbox or the first sheet inspection checkbox may be turned off. In contrast, if the inspection function is used to ensure the test print and checking that have been manually carried out by the user, inspection processing ON can be set to the first sheet or the first copy by turning on the first copy inspection checkbox or the first sheet inspection checkbox.

Figures 6A, 6B:
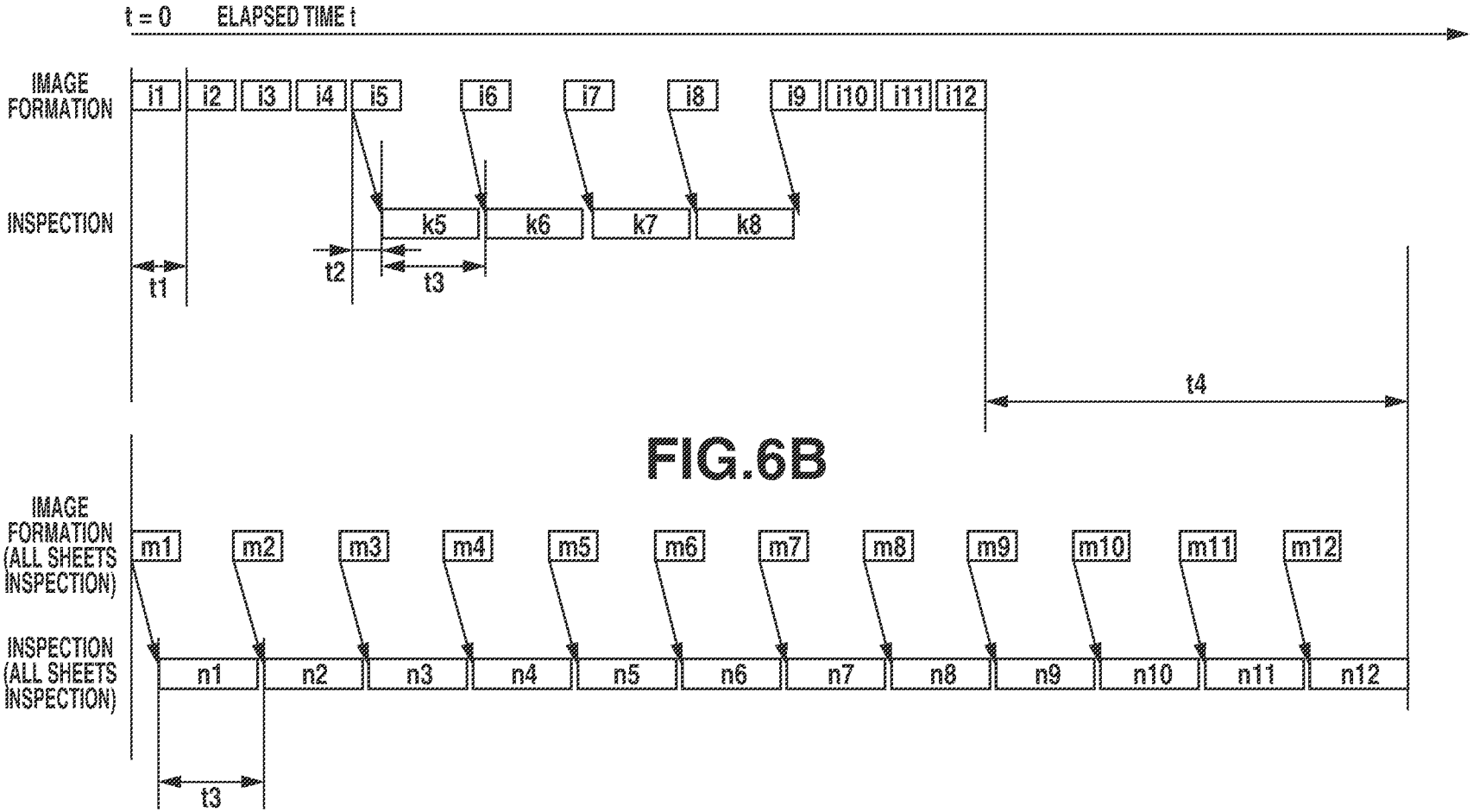
FIGS. 6A and 6B are explanatory diagrams each illustrating how to improve the throughput of the image forming apparatus.

FIGS. 6A and 6B are schematic diagrams each illustrating how the throughput of the image forming apparatus 100 is improved by setting the inspection mode according to the present exemplary embodiment. FIG. 6A illustrates a timing relationship between image formation timings i1 to i12 of the first to twelfth sheets by the image forming unit 120 and inspection timings k5 to k8 at which images formed at the image formation timings i5 to i8 are inspected by the inspection unit 308 when printing is executed in the same job and with the same inspection mode setting as those illustrated in FIG. 5B. As described above with reference to FIG. 5B, inspection processing ON is set to the fifth to eighth sheets, and thus the inspection processing is executed on the images formed at the timings i5 to i8.

From an elapsed time t=0, the CPU 301 executes image formation processing on the first sheet at the image formation timing i1. As described above with reference to FIG. 5B, the first to fourth sheets are not inspected by the inspection unit 308, and then image formation processing is executed on the second to fifth sheets at a time interval t1 during which an image can be formed.

The fifth to eighth sheets are then inspected by the inspection unit 308. At the timing i5, the image forming unit 307 executes image formation processing on the fifth sheet. After a lapse of a time interval t2 for the sheet to reach the line sensor 152 through the fixing unit 170 described above with reference to FIG. 1, the inspection unit 308 starts the inspection processing at the inspection timing k5. After a lapse of a time interval t3 from a time when the inspection unit 308 starts the inspection processing to a time when the next sheet can be received, image formation processing is executed on the sixth sheet at the image formation timing i6 so that the next sheet can reach the line sensor 152.

In this case, the time interval t3 from the time when the inspection unit 308 starts the inspection processing to the time when the next sheet can be received is longer than the time interval t1 during which an image can be formed.

FIG. 6B illustrates a timing relationship between image formation timings m1 to m12 of the first to twelfth sheets by the image forming unit 120 and inspection timings n1 to n12 when the all sheets inspection operation is executed. At each of the timings m1 to m12, image formation processing is executed at the time interval t3 from the time when the inspection unit 308 starts the inspection processing to the time when the next sheet can be received. As illustrated in FIGS. 6A and 6B, the elapsed time t for completion of the inspection timing k12 when the inspection processing is executed on some of the sheets is shorter than the elapsed time t for completion of the inspection timing n12 of the twelfth sheet when the inspection processing is executed on all sheets. Thus, it can be seen that the throughput can be improved by the amount corresponding to a difference time interval t4.

As seen from FIGS. 6A and 6B, an interval between a sheet that is not inspected by the inspection unit 308 and a sheet subsequent to the sheet is shorter than an interval between a sheet that is inspected by the inspection unit 308 and a sheet subsequent to the sheet. In other words, a conveyance interval between a sheet that is not inspected and a sheet subsequent to the sheet is shorter than a conveyance interval between a sheet that is inspected and a sheet subsequent to the sheet. Printing productivity can thereby be increased, if the number of sheets to be inspected by the inspection unit 308 is decreased. According to the present exemplary embodiment, the inspection interval is appropriately set depending on the range in which a defect in a print product is allowable, thereby making it possible to prevent the defect in the printed material from continuously occurring, while maintaining the throughput that can be allowed by the user. While the present exemplary embodiment illustrates an example where the conveyance interval illustrated in FIG. 6A is set in the mode for executing inspection processing on some of the sheets, the present disclosure is not limited to this example. For example, all the sheets may be conveyed at regular intervals and the conveyance interval may be set to be shorter than the conveyance interval set when the all sheets inspection operation is carried out.

Figure 7A:
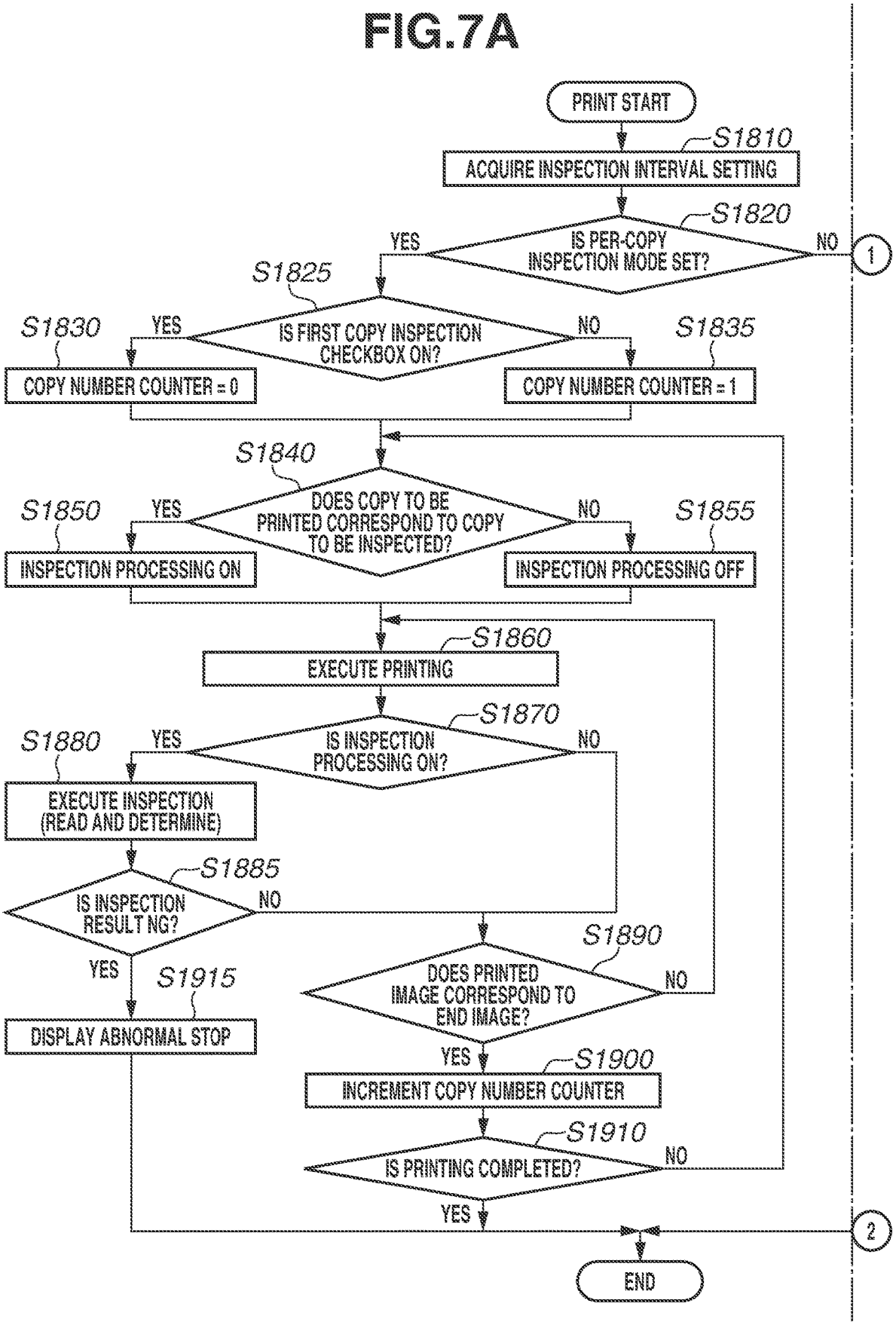
FIGS. 7A and 7B illustrate a flowchart of a control processing flow of the image forming apparatus.
Figure 7B:
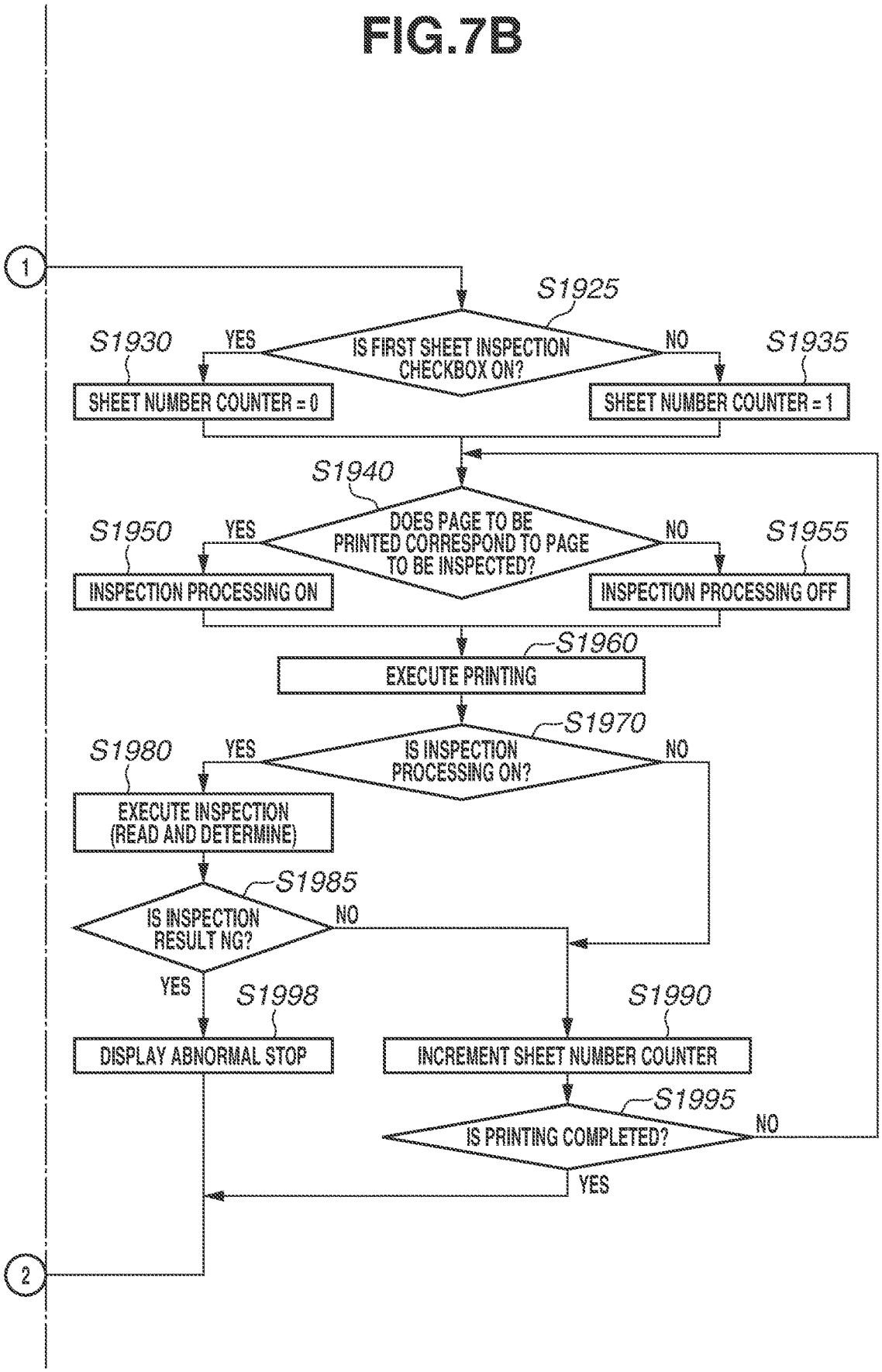

FIGS. 7A and 7B illustrate a flowchart of a print operation according to the present exemplary embodiment. Each step in the flowchart illustrated in FIGS. 7A and 7B is executed by the CPU 301 illustrated in FIG. 2. When a print job is input from the external I/F 304, the CPU 301 starts processing in the flowchart illustrated in FIGS. 7A and 7B. In step S1810, the inspection mode setting made using the operation unit 309 is acquired from the RAM 303 as described above with reference to FIGS. 4A to 4C. In step S1820, the type of the inspection mode setting stored in the RAM 303 is determined. If the per-copy inspection mode is set as the inspection mode setting (YES in step S1820), the CPU 301 executes inspection processing in the per-copy inspection mode on the input print job. First, a copy number counter stored in the RAM 303 is reset. If check ON is stored as the result of the first copy inspection checkbox in the RAM 303 (YES in step S1825), the processing proceeds to step S1830. In step S1830, the copy number counter is reset to "0" to execute the inspection processing on the first copy. In step S1840, it is determined whether the copy to be printed corresponds to a copy to be inspected. The CPU 301 executes the inspection processing when the remainder obtained after dividing the copy number counter by the inspection interval stored in the RAM 303 is "0". If the copy number counter indicates "0", the processing proceeds to step S1850, accordingly. In step S1850, it is determined that the inspection processing is ON. If the result of the checkbox indicates check OFF (NO in step S1825), the processing proceeds to step S1835. In step S1835, the copy number counter is reset to "1". In cases other than the case where the inspection interval=1 is set to inspect all pages, the processing thus proceeds to step S1855. In step S1855, it is determined that the inspection processing is OFF.

In step S1860, image formation processing is executed on the first page. If the inspection processing is ON (YES in step S1870), the processing proceeds to step S1880. In step S1880, the inspection determination is executed as described above with reference to FIG. 3. If the inspection result indicates NG (YES in step S1885), the processing proceeds to step S1915. In step S1915, an abnormal stop is displayed on the UI 150 as described above with reference to FIG. 4C and the print operation is suspended. In this case, the CPU 301 informs the UI 150 that it is determined that a defect has been detected in the printed material as a result of inspection. In contrast, if the result in step S1870 indicates NO, the inspection determination is not executed. In this case, the CPU 301 does not execute the processing of reading the image on the sheet with the line sensor 152. If the inspection result in step S1885 is OK (NO in step S1885), the processing proceeds to step S1890. In step S1890, it is determined whether the image printed in step S1860 does not correspond to the end image of the copy. If the printed image does not correspond to the end image (NO in step S1890), the processing returns to step S1860 to execute image formation processing on the next page. In this case, if the inspection processing on the previous page is ON, the image formation processing is executed at the inspection interval t3 described above with reference to FIGS. 6A and 6B. In contrast, if the inspection processing on the previous page is OFF, the image formation processing is executed at the image formation interval t1. Thereafter, steps S1860 to S1890 are repeated until the processing on the end image of the copy is completed.

If it is determined that the printed image corresponds to the end image of the copy in step S1890 (YES in step S1890), the processing proceeds to step S1900. In step S1900, the copy number counter stored in the RAM 303 is incremented. In step S1910, it is determined whether the input print job is completed. If there are remaining copies to be printed (NO in step S1910), the processing returns to step S1840 to determine whether the remaining copies correspond to copies to be inspected. As described above, in step S1840, it is determined whether the copies to be printed correspond to copies to be inspected based on the inspection interval stored in the RAM 303. The subsequent steps are similar to steps S1840 to S1910 described above. If it is determined that the print job is completed in step S1910 (YES in step S1910), the processing in the flowchart illustrated in FIGS. 7A and 7B is terminated.

The inspection processing is executed on the input print job in the per-page inspection mode. In step S1930, a sheet number counter stored in the RAM 303 is reset to "0". If check ON is stored as a result of the first sheet inspection checkbox in the RAM 303 (YES in step S1925), the processing proceeds to step S1930. In step S1930, the sheet number counter is reset to "0" to execute the inspection processing on the first sheet. In step S1940, it is determined whether the page to be printed corresponds to a page to be inspected. The CPU 301 executes the inspection processing when the remainder obtained after dividing the sheet number counter by the inspection interval stored in the RAM 303 is "0". Thus, if the sheet number counter is "0", the processing proceeds to step S1950. In step S1950, it is determined that the inspection processing is ON. If the result of the checkbox indicates check OFF (NO in step S1925), the processing proceeds to step S1935. In step S1935, the sheet number counter is reset to "1". Accordingly, in cases other than the case where the inspection interval=1 is set to inspect all pages, the processing proceeds to step S1955. In step S1955, it is determined that the inspection processing is OFF.

In step S1960, image formation processing is executed on the first page. If the inspection processing is ON (YES in step S1970), the processing proceeds to step S1980. In step S1980, the inspection determination is executed as described above with reference to FIG. 3. If the inspection result is NG (YES in step S1985), the processing proceeds to step S1998. In step S1998, the abnormal stop is displayed as described above with reference to FIG. 4C and the print operation is suspended. In contrast, if the result in step S1970 indicates NO, the inspection determination is not executed. In this case, the CPU 301 does not execute the processing of reading the image on the sheet with the line sensor 152.

If the inspection result in step S1985 is OK (NO in step S1985), the processing proceeds to step S1990. In step S1190, the sheet number counter stored in the RAM 303 is incremented. In step S1995, it is determined whether the input print job is completed. If the image printed in step S1960 does not correspond to the end image in the input print job (NO in step S1995), the processing returns to step S1940 to determine whether the next page corresponds to a page to be inspected. As described above, it is determined whether the next page corresponds to a page to be inspected based on the inspection interval stored in the RAM 303. In step S1960, the image formation processing is executed on the next page. As described above, if the inspection processing on the previous page is OFF, the throughput can be improved by the amount corresponding to the interval between the inspection interval t3 and the image formation interval t1. The subsequent steps are similar to steps S1940 to S1990 described above. If it is determined that the print job is completed in step S1995 (YES in step S1995), the processing in the flowchart illustrated in FIGS. 7A and 7B is terminated.

If the all sheets inspection mode is set as the inspection mode setting stored in the RAM 303 (NO in step S1820), the processing proceeds to step S1960 and subsequent steps. In step S1960, the image formation processing on the first sheet is first executed. In step S1980, the inspection determination is executed as described above with reference to FIG. 3. If the inspection result is NG (YES in step S1985), the processing proceeds to step S1998. In step S1998, the abnormal stop is displayed on the UI 150 as described above with reference to FIG. 4C and the print operation is suspended. In this case, the CPU 301 informs the UI 150 that a defect has occurred in the printed material as a result of inspection.

If the inspection result in step S1985 is OK (NO in step S1985), the processing proceeds to step S1995. In step S1995, the CPU 301 determines whether the input print job is completed. If the image printed in step S1960 does not correspond to the end image in the input print job, the image formation processing is executed on the next page in step S1960. In the all sheets inspection mode, inspection processing ON is always set to the previous page. Thus, the image formation interval corresponds to the inspection interval. If it is determined that the print job has been completed in step S1995 (YES in step S1995), the processing in the flowchart illustrated in FIGS. 7A and 7B is terminated.

As described above, the image forming apparatus 100 according to the present exemplary embodiment includes a mode for executing inspection processing on all printed material in a print job, and a mode for executing inspection processing on some of the printed materials in the print job. Further, the image forming apparatus 100 includes the per-copy inspection mode and the per-page inspection mode as the mode for executing inspection processing on some of the printed materials. In these inspection modes, the inspection processing is executed on some of the printed materials depending on the inspection interval setting. Consequently, an improvement in throughput time for a multi-function peripheral and guarantee of a product with an inspection function can be achieved.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure includes exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-156551, filed Sep. 17, 2020, which is hereby incorporated by reference herein in its entirety.

What is claimed is:

1. An image forming apparatus comprising:

an image forming unit configured to form an image on a sheet;

a reading unit configured to read the image on the sheet, the image being formed by the image forming unit; and an inspection unit configured to inspect whether an image formation failure has occurred by comparing the image read by the reading unit with a reference image registered in advance, wherein the image forming apparatus executes the inspection with the inspection unit in a first inspection mode or a second inspection mode, wherein the first inspection mode is a mode in which the inspection unit executes the inspection on all sheets on which the image is formed by the image forming unit, and wherein the second inspection mode is a mode in which the inspection unit executes the inspection on some of the sheets on which the image is formed by the image forming unit, and the inspection unit does not execute the inspection on the other sheets.

2. The image forming apparatus according to claim 1, wherein the reading unit reads the image on the sheet conveyed through a conveyance path, and wherein in the second inspection mode, a conveyance interval of the other sheets on which the inspection is not executed by the inspection unit is shorter than a conveyance interval of the sheets in the first inspection mode.

3. The image forming apparatus according to claim 1, further comprising a setting unit configured to set an inspection interval as an interval at which the inspection unit executes the inspection on the sheets in the second inspection mode.

4. The image forming apparatus according to claim 3, wherein the setting unit sets a number of sheets as the inspection interval, and wherein in the second inspection mode, the inspection unit executes the inspection on every other sheets set as the number of sheets.

5. The image forming apparatus according to claim 3, wherein the setting unit sets a number of copies as the inspection interval, and wherein in the second inspection mode, the inspection unit executes the inspection on every other copies set as the number of copies.

6. The image forming apparatus according to claim 1, further comprising a control unit configured to cause the image forming unit to suspend an operation in a case where the inspection unit determines that the image formation failure has occurred.

7. The image forming apparatus according to claim 1, further comprising:

a first discharge tray onto which a sheet on which the inspection unit does not determine that the image formation failure has occurred is discharged; and a second discharge tray onto which a sheet on which the inspection unit determines that the image formation failure has occurred is discharged.

8. The image forming apparatus according to claim 1, further comprising an informing unit configured to inform that the inspection unit determines that the image formation failure has occurred.

9. The image forming apparatus according to claim 1, wherein in the second inspection mode, the reading unit does not execute image reading on the other sheets on which the inspection is not executed by the inspection unit.

* * * * *